US005446931A

United States Patent [19]

Wei

[11] Patent Number: 5,446,931

[45] Date of Patent: Sep. 5, 1995

[54] CHILDREN'S PLAYYARD

[76] Inventor: Hsieh.H. Wei, P.O. Box 82-144, Taipei,

[21] Appl. No.: 130,996

[22] Filed: Oct. 4, 1993

[51] Int. Cl.[6] ..... A47D 7/00

[52] U.S. Cl. ..... 5/98.1; 5/99.1; 403/63; 403/58

[58] Field of Search ..... 5/98.1, 99.1; 403/53, 403/58, 59, 61, 63

[56] References Cited

U.S. PATENT DOCUMENTS

| | | | |
|---|---|---|---|
| 4,688,280 | 8/1987 | Kohus et al. | 5/99.1 |
| 4,811,937 | 3/1989 | Dillner et al. | 5/99.1 |
| 5,197,154 | 3/1993 | Shamie | 5/99.1 |
| 5,211,498 | 5/1993 | Huang | 5/99.1 X |
| 5,239,714 | 8/1993 | Huang | 5/99.1 |
| 5,279,006 | 1/1994 | Teng | 5/99.1 |
| 5,293,656 | 3/1994 | Chan | 5/99.1 |

*Primary Examiner*—Michael F. Trettel
*Attorney, Agent, or Firm*—Alfred Lei

[57] ABSTRACT

This invention relates to a children's playyard and in particular to one including: a central hub having a cover plate and a base, said cover plate being formed with six square openings, said base having four chambers and two recesses, each of said chambers having a circular member having a center hole; a coupling member rotatably received in each of the four chambers of said base and having a hole adapted to receive the circular member of said chamber; a hub leg pivotally connected with the coupling member and each of the two recesses of said central hub; a connector having a sleeve and a pair of lugs pivotally connected with said hub leg; a corner leg inserted into the sleeve of said connector and rotatably connected therewith; a connecting member connected with an upper end of said corner leg; a rail connected between two adjacent connecting members and having a locking device; whereby the children's playyard will not be collapsed accidentally thereby preventing the baby from being hurt.

2 Claims, 9 Drawing Sheets

CHILDREN'S PLAYYARD

BACKGROUND OF THE INVENTION

It has been found that the prior art children's playyard sold in the marketplace is often collapsed accidentally thereby hurting the baby therein. As illustrated in FIG. 1, the collapsible mechanism of such children's playyard is provided with a central hub C connected with four corner legs and the intermediate portion of two base rods by hub legs R. The hub leg R is pivotally connected with a recess T of the central hub C so that the hub leg R will be rotated in the recess T so as to erect or collapse the playyard. To erect the playyard, the central hub C is pushed downwardly to bring the hub legs R to the horizontal co-planar spread configuration with the corner legs upstanding. However, in case the playyard is accidentally hitted by an external force, the hub legs R will be forced to turn upward thereby collapsing the playyard suddenly and causing injury to the baby therein.

Therefore, it is an object of the present invention to provide an improved collapsible children's playyard which may obviate and mitigate the above-mentioned drawbacks.

SUMMARY OF THE INVENTION

This invention relates to an improvement in a collapsible children's playyard.

It is the primary object of the present invention to provide a collapsible children's playyard which will not fold accidentally.

It is another object of the present invention to provide a collapsible children's playyard which is safe in use.

It is another object of the present invention to provide a collapsible children's playyard which can be easily folded.

It is still another object of the present invention to provide a collapsible children's playyard which is easy to operate.

It is a further object of the present invention to provide a collapsible children's playyard which is easy to open.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
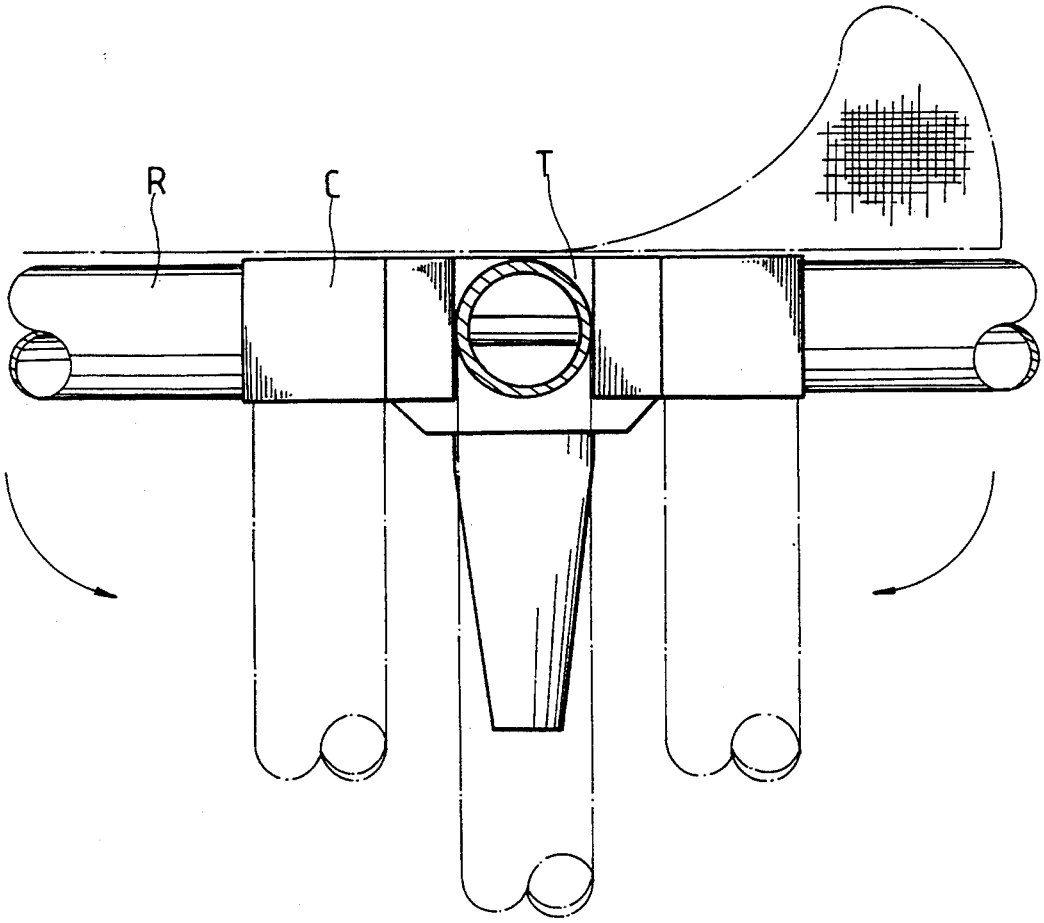
PRIOR ART FIG. 1
FIG. 1 shows a prior art folding playyard.
Figure 2:
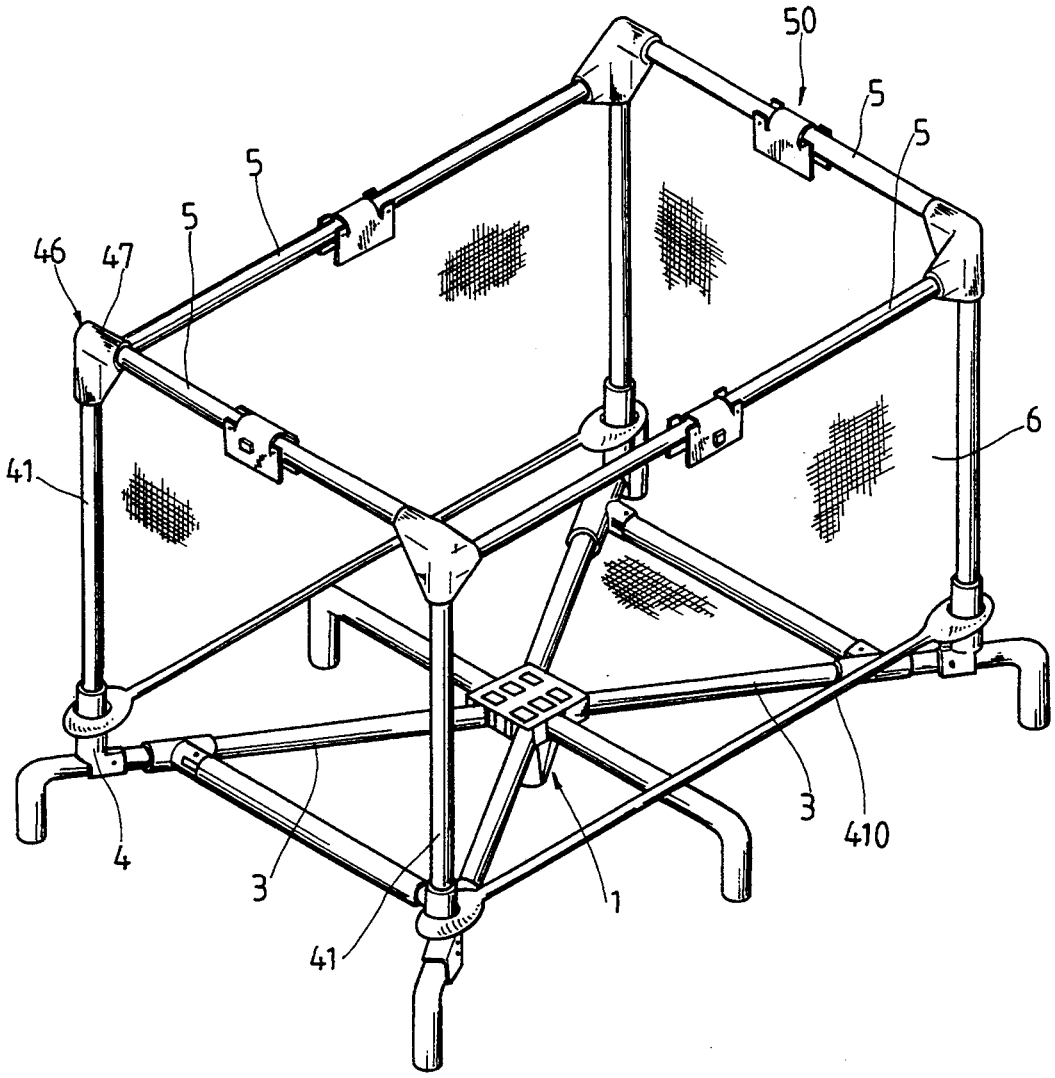
FIG. 2 is a perspective view of a children's playyard according to the present invention.
Figure 3:
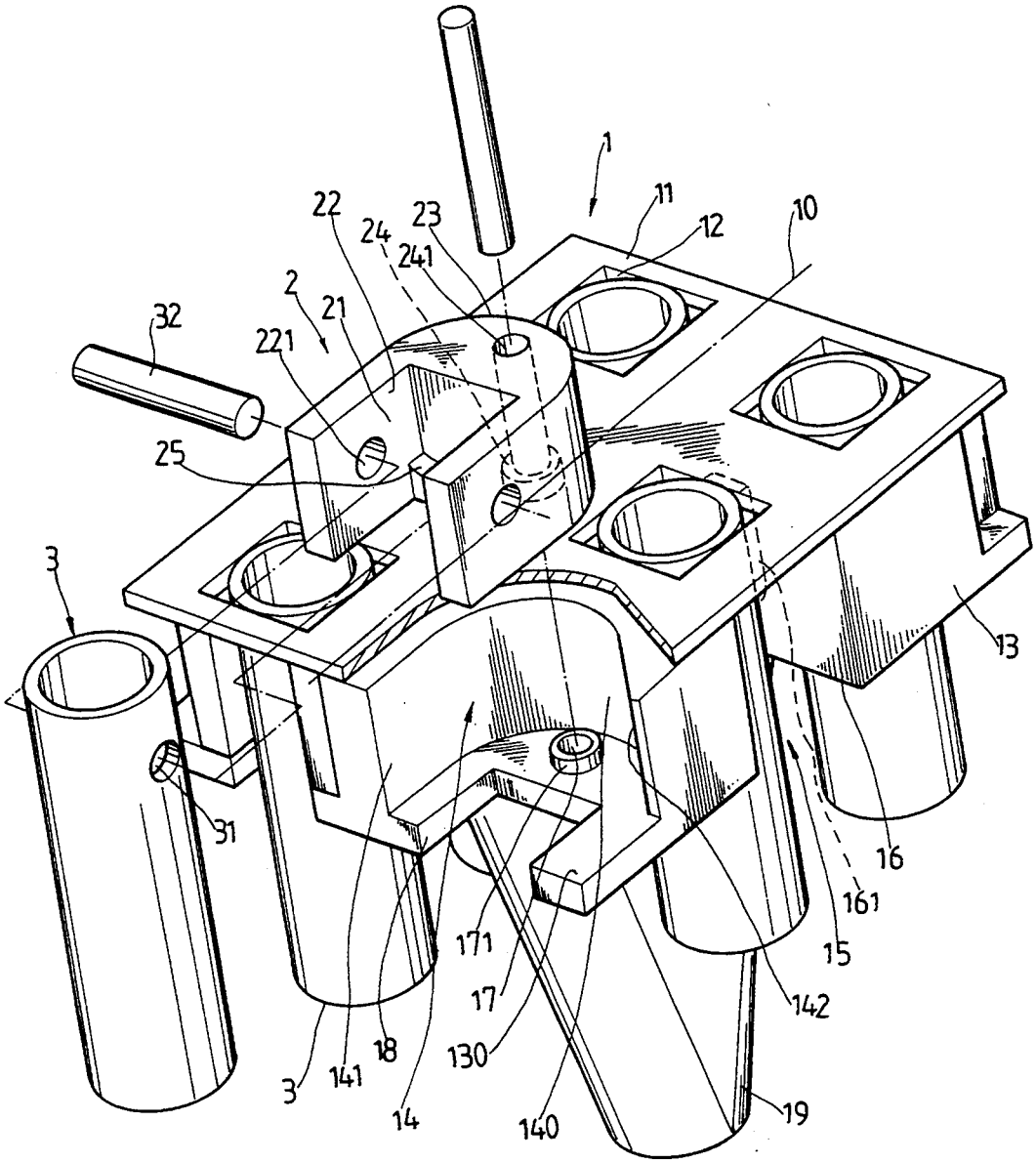
FIG. 3 is exploded view of the central hub.
Figure 3A:
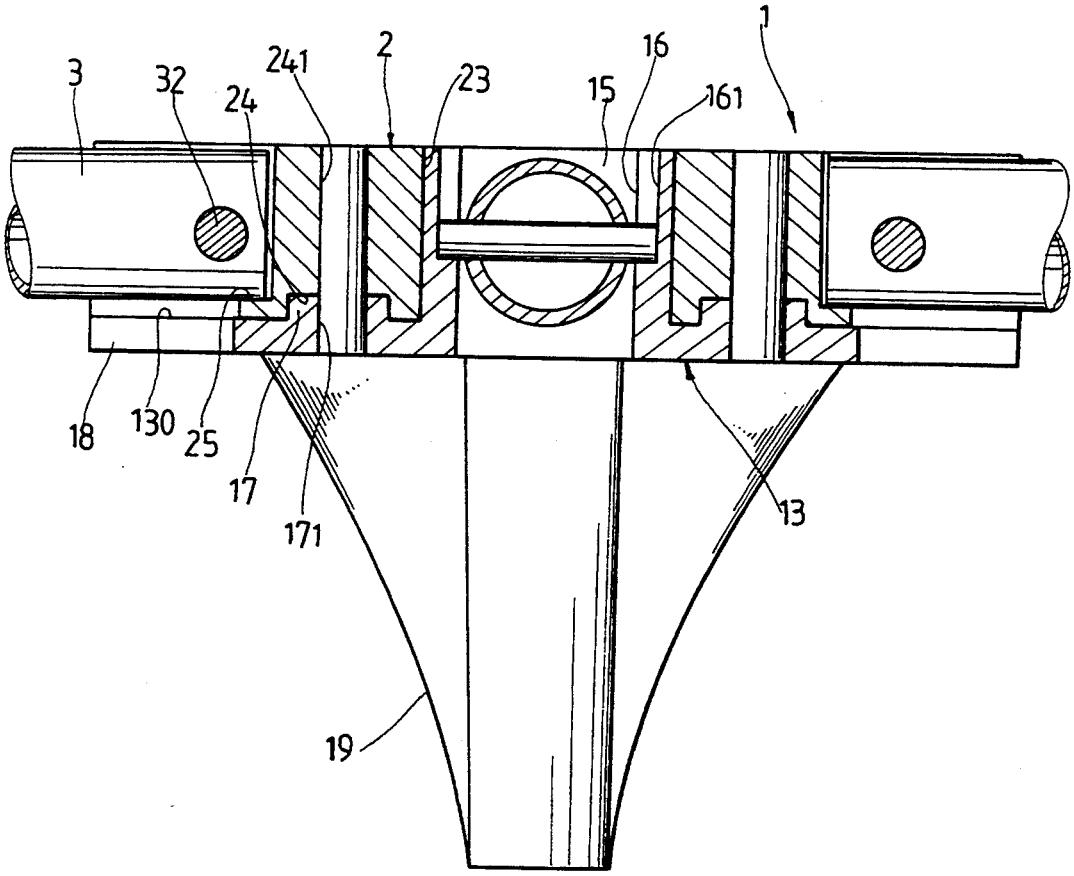
FIG. 3A is a sectional side view of the central hub.
Figure 4:
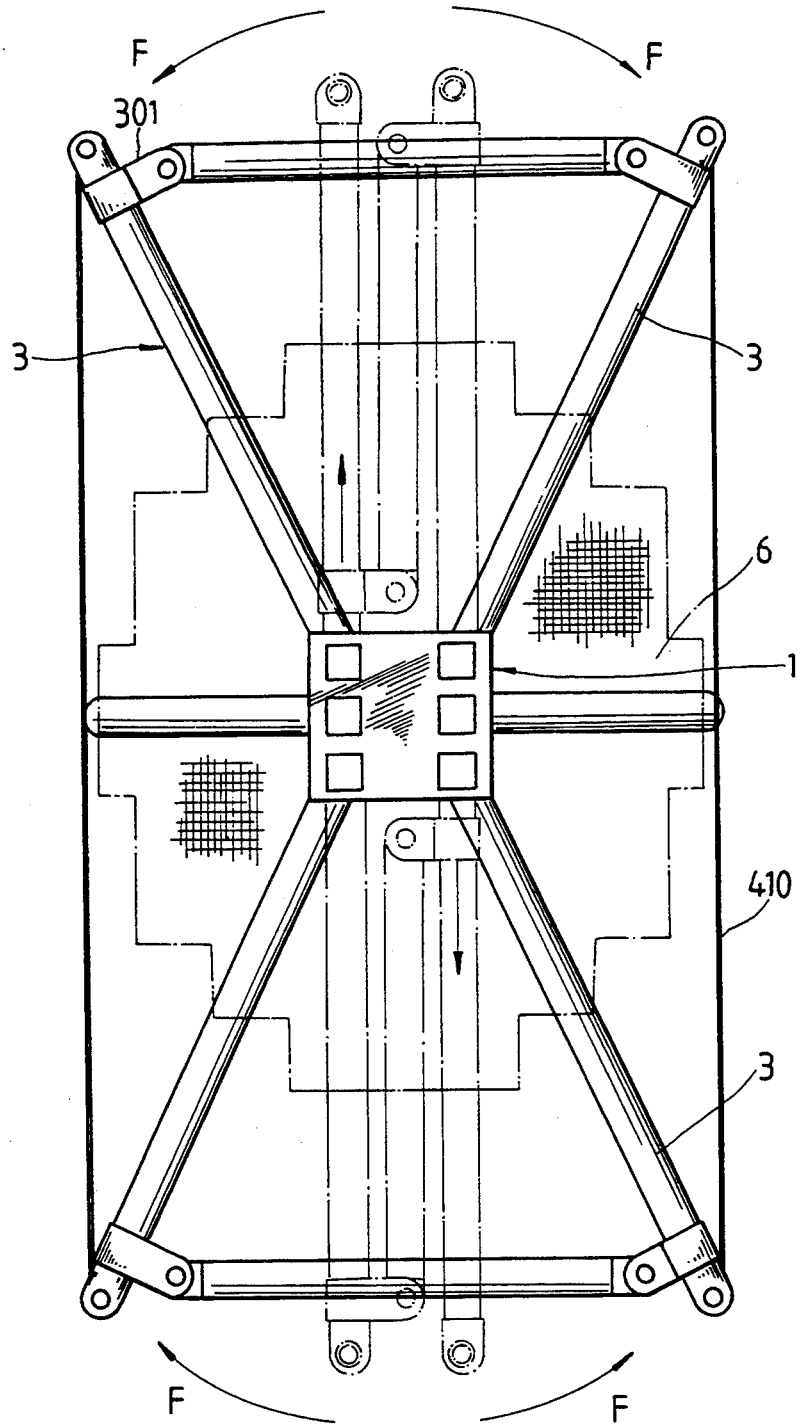
FIG. 4 shows the way how the children's playyard is opened by pressing the central hub.

With reference to the drawings and in particular to FIGS. 2 and 3 thereof, the collapsible children's playyard according to the present invention mainly comprises a central hub 1, a plurality of coupling members 2, a plurality of hub legs 3, a plurality of connectors 4, a plurality of corner legs 41, a plurality of rails 5, and a flexible enclosure 6.

The central hub 1 includes a cover plate 11 and a base 13. The cover plate 11 is formed with six openings 12 each adapted to receive a hub leg 3. The base 13 is formed with four chambers 14 each having an inner wall 141 and a fixing wall 142. Between two chambers 14 there is a recess 15 having an inner wall 16 on which is mounted a seat member 161.

The bottom of the chamber 14 is formed with a notch 18 and a circular member 17 having a center hole 171. The base 13 is provided with a central support 19.

The coupling member 2 is formed with a U-shaped recess 21, two arms 22 each having a hole 221, and an opening composed of a first hole 241 and a second hole 24. The second hole 24 is larger than the first hole 241 in diameter and may just receive the circular member 17 of the bottom of the chamber 14. As the coupling member 2 is disposed within the chamber 14, the circular member 17 of the bottom of the chamber 14 will just fit into the second hole 24 of the coupling member 2. Further, the U-shaped recess 21 of the coupling member 2 is designed so that a hub leg 3 may be rotatably connected with the U-shaped recess 21.

The hub leg 3, which is formed with a hole 31 at the upper end, is inserted into the U-shaped recess 21 of the coupling member 2 and fixedly connected thereto by inserting a pin 32 through the holes 221 of the coupling member 2 and the hole 31 of the hub leg 3. Further, each of the recesses 15 of the base 13 is pivotally connected with a hub leg 3. The hub leg 3 is provided with a depending foot 33 (see FIG. 5) for supporting the playyard on the ground.

The connector 42 includes a sleeve 42 and a pair of lugs 43 which are pivotally connected with the hub leg 3 so that the hub leg 3 can be rotated with respect to the connector 42. As the playyard is erected, the upper part 330 of the hub leg 3 will be in contact with the lower end 420 of the sleeve 42 of the connector 4. In addition, the connector 42 is formed with a slot 44.

The corner leg 41 is inserted into the sleeve 42 of the connector 42 and has a resilient plate 45 on which is mounted a ball 451. The ball 451 is engaged with the slot 44 of the connector 4 so that the corner leg 41 can be rotated through a certain angle.

Figure 5:
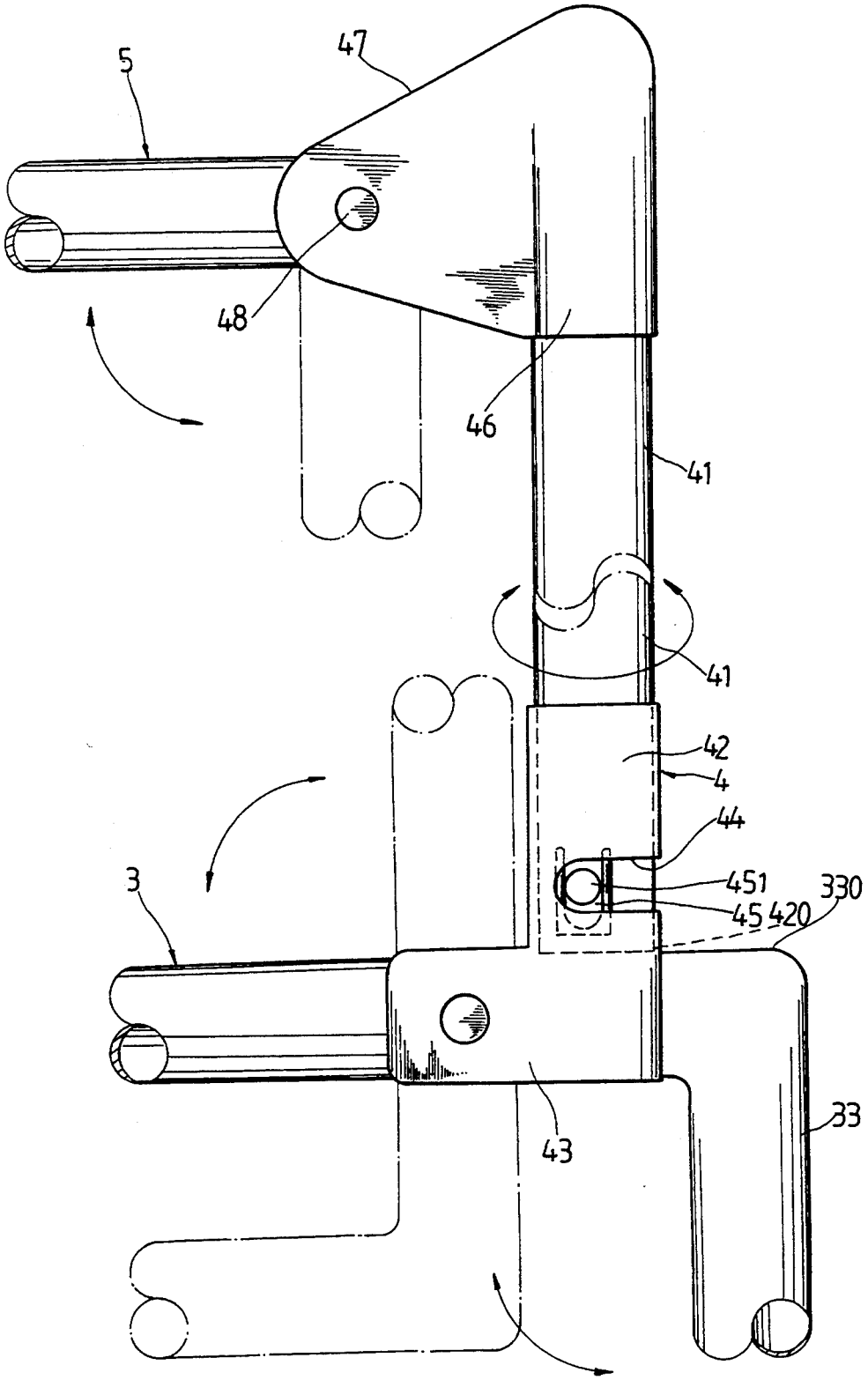
FIG. 5 illustrates the engagement between the corner leg and the connector.
Figure 6:
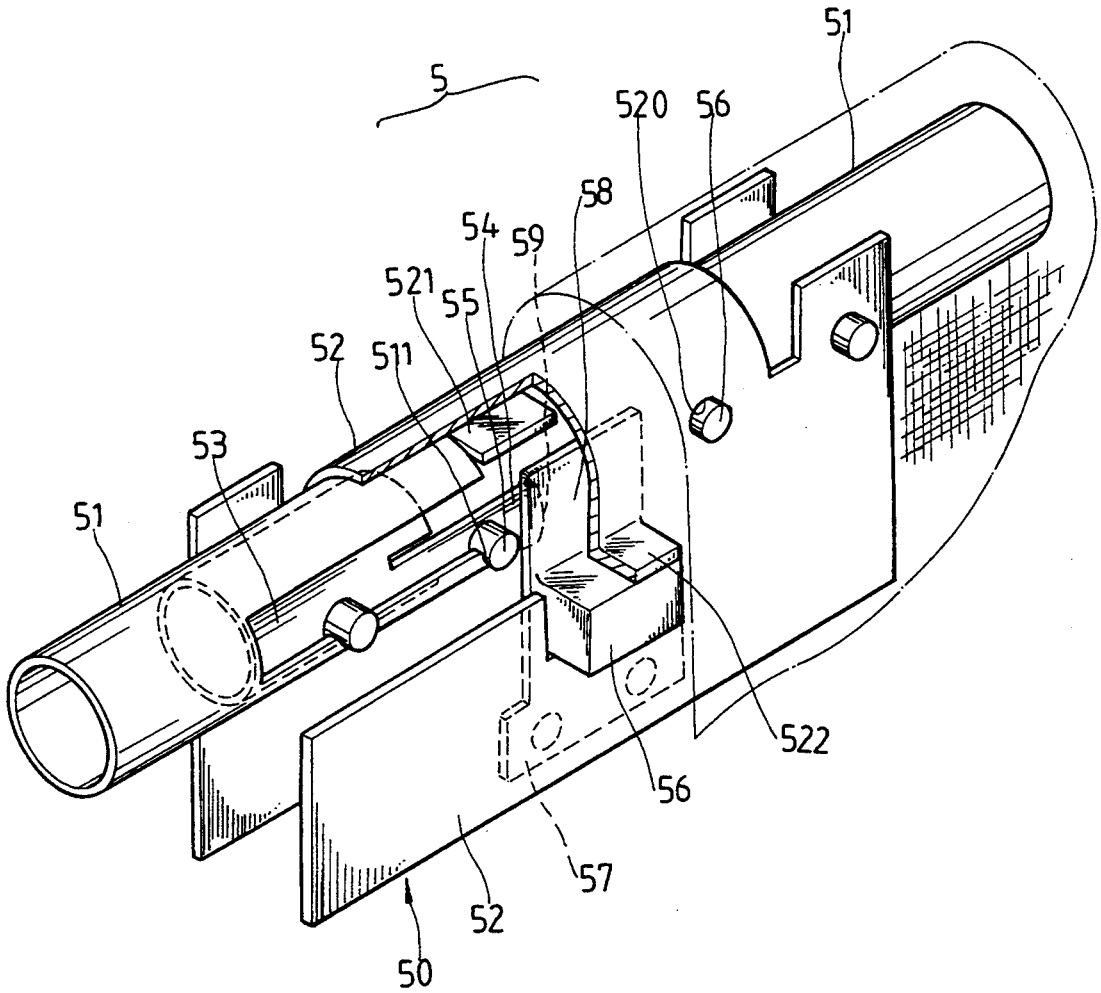
FIG. 6 is a perspective view of the locking device.
Figure 7:
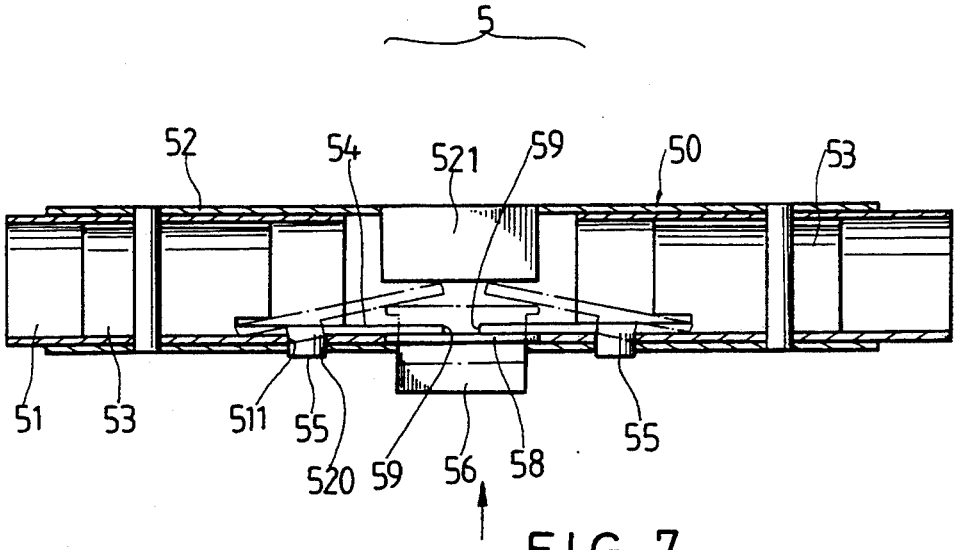
FIG. 7 is a sectional view of the locking device.

The upper end of the corner leg 41 is connected with a connecting member 46 which is a pipe connector 47 with a hole 48 (see FIG. 5).

Two corner legs 41 are connected with an elastic band 410 the normal length of which is shorter the distance between the two corner legs 41.

Adjacent corner legs 41 are connected at the upper end with a rail 5 which is composed of two rods 51 pivotally connected with a locking plate 52 of a locking device 50. Further, the rod 51 is provided with a locking tubular member 53 which has a resilient plate 54 on which is mounted a protuberance 55. When the playyard is erected, the protuberance 55 will extend into the hole 511 of the rod 51 and the hole 520 of the locking plate 52 so that the rods 51 cannot be rotated. A resilient plate 57 is riveted on the locking plate 52 and has a push plate 58 which is normally located under the front plate 59 of the rods 5. The locking plate 52 is formed with a stop plate 521 so as to limit the distance that the pushbutton 58 goes thereby preventing the resilient plates 54 from being damaged.

Figure 8:
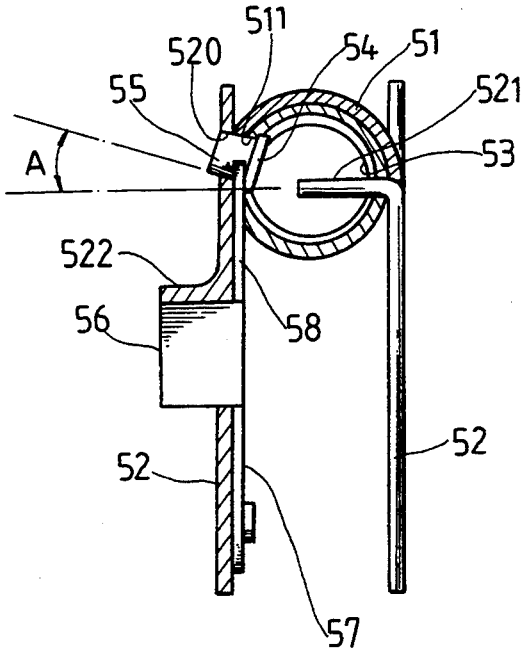
FIG. 8 is a sectional side view of FIG. 7.
Figure 9:
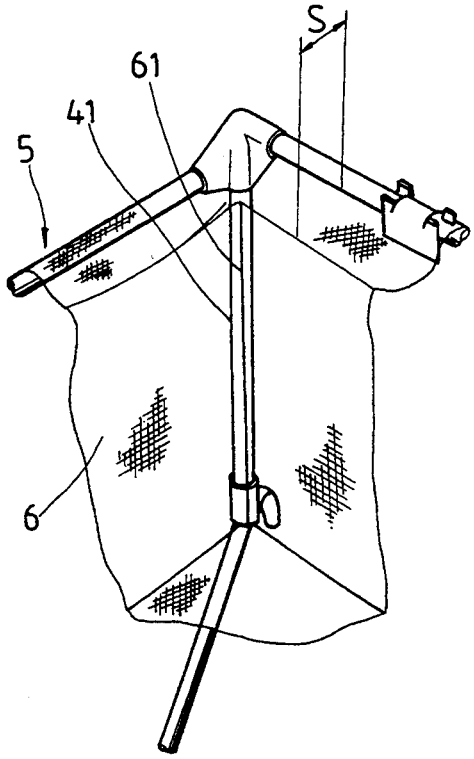
FIG. 9 shows the connection between the flexible enclosure and the corner leg.

The protuberance 55 makes an angle A with the horizontal (see FIG. 8) so that when the playyard is erected and all rods 51 will be pressed downward, the pushbutton 56 will not be pressed inadvertently. When desired to fold the playyard, simply lift the locking device 50 so as to disengage the protuberance 55 from the locking hole 54 and pin hole 520.

When in use, first lift the locking devices 50 so that the rods 51 will be engaged with the locking devices 50 and press the central hub 1 so that the hub legs 3 are turned outward until the hub legs 3 are detached from the openings 12 of the stop plate 11. Meanwhile the elastic bands 410 will apply force F to pull the hub legs 3 thereby opening the playyard and the coupling members 2 are rotated so that the hub legs 3 are rotated and do not locate under the opening 12 of the stop plate 11. Hence, the hub legs 3 cannot be rotated upward. Further, the hub leg 3 lies on the bottom 130 of the recess 14 thereby making it unable to be rotated downward. Therefore, the playyard may be prevented from being folded accidentally. When desired to fold the playyard, first lift the locking device 50 and press the pushbutton 56 so as to release the rod 51. Then rotate the hub legs 3 connected with the corner legs 41 inwards. As the front end of the hub leg 3 is located under the opening 12 of the cover plate 11, rotate the hub leg 3 downward until the upper end of the hub leg 3 is received in the opening 12 of the cover plate 11.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A children's playyard comprising:

a central hub having a cover plate and a base, said cover plate being formed with six square openings, said base having four chambers and two recesses, each of said chambers having a circular member having a center hole;

a coupling member rotatably received in each of the four chambers of said base and having a hole adapted to receive the circular member of said chamber;

a hub leg each pivotally connected with each of the coupling members and each of the two recesses of said central hub;

a connector having a sleeve and a pair of lugs pivotally connected with said hub leg connected to a coupling member;

a corner leg inserted into the sleeve of said connector and rotatably connected therewith;

a connecting member connected with an upper end of said corner leg; and a rail connected between two adjacent connecting members and having a locking device.

2. The children's playyard as claimed in claim 1, further comprising two elastic bands each connected between two corner legs.

* * * * *